United States Patent [19]

Shepherd

[11] 4,426,990

[45] Jan. 24, 1984

[54] CAMPING STOVE

[75] Inventor: Charles G. Shepherd, Oakville, Canada

[73] Assignee: B. D. Wait Company Limited, Oakville, Canada

[21] Appl. No.: 258,338

[22] Filed: Apr. 28, 1981

[30] Foreign Application Priority Data

Apr. 1, 1981 [CA] Canada ..... 374413

[51] Int. Cl.[3] ..... F24C 1/16; B65D 51/04

[52] U.S. Cl. ..... 126/9 B; 220/334; 126/44; 126/38

[58] Field of Search ..... 126/30, 9 B, 38, 37 B, 126/25 R, 25 A, 44; 220/334, 342, 340, 341

[56] References Cited

U.S. PATENT DOCUMENTS

| | | | |
|---|---|---|---|
| 982,440 | 1/1976 | Koziol | 126/104 |
| 1,611,904 | 12/1926 | Goldberg | 126/38 |
| 2,909,170 | 10/1959 | Hathorn | 126/9 B |
| 3,643,645 | 2/1972 | Benson | 126/38 |
| 4,062,340 | 12/1977 | Huff | 126/25 |
| 4,090,490 | 5/1978 | Riley | 126/25 |

FOREIGN PATENT DOCUMENTS

| | | | |
|---|---|---|---|
| 113064 | 2/1918 | United Kingdom | 220/334 |

*Primary Examiner*—Samuel Scott
*Assistant Examiner*—G. Anderson
*Attorney, Agent, or Firm*—Hirons, Rogers & Scott

[57] ABSTRACT

A portable stove for camping and the like has a housing of sheet metal, comprising a dish-shaped lid and a dish-shaped base with burners accommodated in the base, the lid and the base being formed from identical work-pieces with front, rear and side walls of the lid having the same length and height dimensions as those of the base to reduce manufacturing costs. The lid and the base are each formed with a curled rim for reinforcement and to facilitate pivotal connection of the base to the lid by tabs projecting from the base and wrapped around the lid rim. Windshields are pivotally connected to the base by tabs projecting from the windshields and wrapped around the rim at the side walls of the base.

5 Claims, 6 Drawing Figures

CAMPING STOVE

The present invention relates to portable stoves for use, for example, as camping stoves.

One well known type of camping stove has a housing of sheet metal formed in two parts, namely a lid and a base, which are pivotally connected together, so that the lid can be raised into an erected, open position, in which the lid is upstanding from the rear of the base, the lid being releasably held in this position by windshields pivotally secured to opposite sides of the base and the base containing burners for heating food.

It is an object of the present invention to provide a novel and improved portable stove which is less expensive to manufacture.

According to the present invention, there is provided a portable stove comprising a housing made of sheet metal, the housing comprising a first housing portion forming a lid and a second housing portion forming a base, burner means in the base for heating food, the lid and the base each being dish-shaped and having a front wall, a rear wall and a opposed side walls, and the lid and the base being formed from identical work pieces with the front, rear and side walls of the lid having the same length and height dimensions as the corresponding walls of the base.

Thus, during the manufacture of the stove, identical dish-shaped work pieces can be manufactured from sheet metal in a pressing operation and these work pieces can then be differently modified, according to whether they are intended to form the lids or the bases of stoves. In this way, the production of different pressings for the lids and the bases is avoided and, consequently, the tooling and manufacturing costs for the stoves are substantially reduced.

The lid and the base are preferably each formed with a periphiral curled rim, the purpose of these rims being to reinforce the edges of the lid and base walls and to avoid sharp edges on the lid of the base, which might otherwise cause the risk of injury by cutting the user of the stove.

Further manufacturing economies can be obtained, together with a strong construction of the stove, by pivotally connecting the rear wall of the lid to the rear wall of the base by means of projections in the form of tabs extending from one of these components and wrapped in pivotal relation around the curled rim of the other of these two components. In a preferred embodiment of the invention, these tabs are provided on a sheet metal member which is secured within the base to rear wall of the base, the rear wall of the lid being provided with openings receiving the tabs therethrough and the sheet metal member further being formed with flanges bent to serve as support brackets, so that the sheet metal member performs dual functions.

The invention will be more readily understood from the following description of a preferred embodiment thereof given, by way of example, with reference to the accompanying drawings, in which:

FIG. 1 shows a view in perspective of a camping stove embodying the present invention, with parts thereof illustrated in an exploded condition;

FIGS. 2 and 3 show partial cross sectional views taken along the lines 2—2 and 3—3 of FIG. 1;

Figure 1:
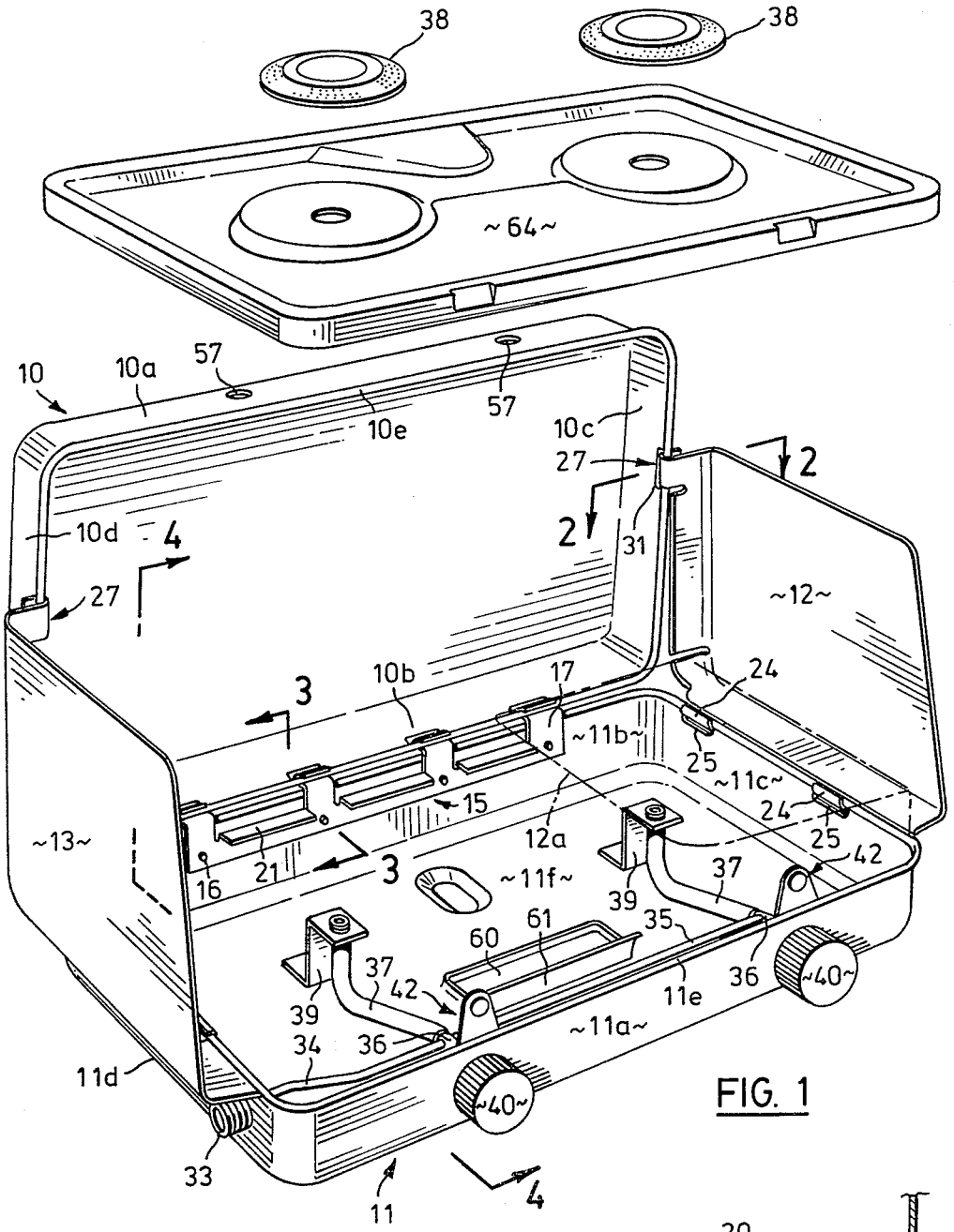

As shown in the drawings, the stove has a housing of sheet metal formed in two parts, namely a dish-shaped lid 10 and a dish-shaped base 11. The lid 10 has a front wall 10*a*, a rear wall 10*b* and opposed side walls 10*c* and 10*d* and the base 11 has a front wall 11*a*, a rear wall 11*b* and opposed side walls 11*c* and 11*d*.

Figure 4:
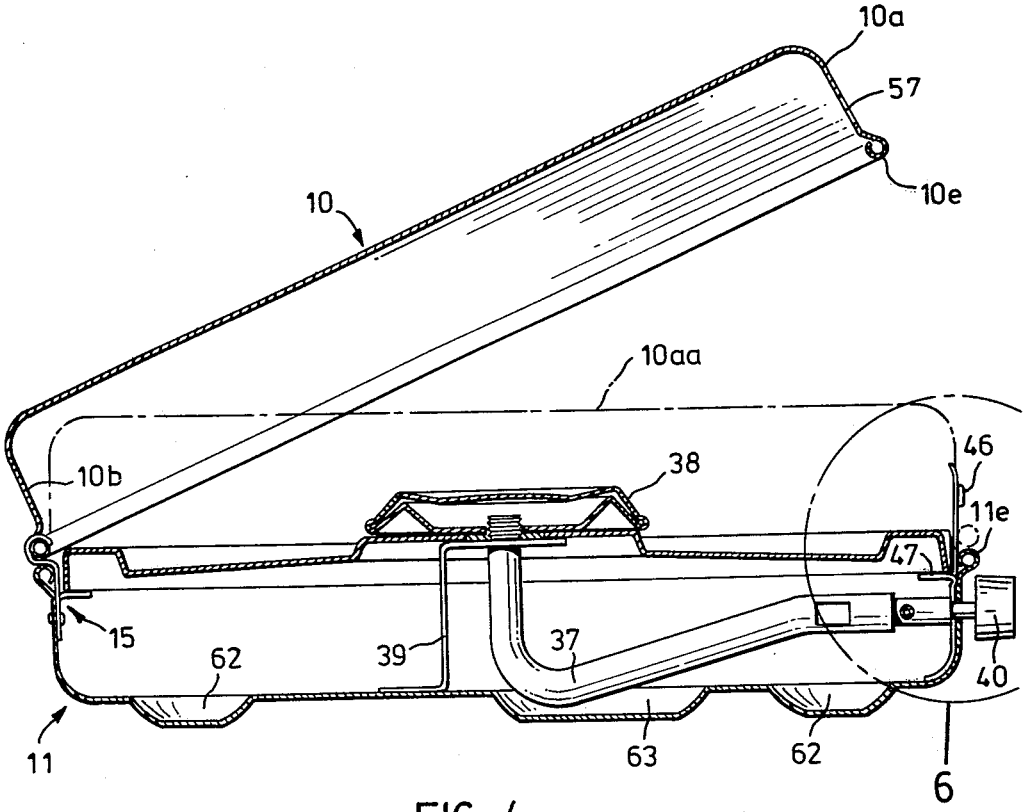
FIG. 4 shows a view taken in transverse cross section through the stove of FIG. 1, with the components thereof assembled and with a lid of the stove in a partly closed position.

The lid 10 is pivotally secured to the base 11 for pivotation between an erect, open position, in which the lid 10 is shown in FIG. 1 and is upstanding from the rear wall 11*b* of the base 11, and a closed position, indicated by reference numeral 10*aa* and shown by dash-dot lines in FIG. 4.

A pair of opposed windshields 12 and 13 are pivotally secured to the side walls 11*c* and 11*d*, respectively, of the base 11 and are pivotally movable between erected positions, in which the windshields 12 and 13 are shown in FIG. 1 in full lines and collapsed positions, one of which is indicated in dash-dot lines in FIG. 1 and indicated by reference numeral 12*a*.

The lid 10 has a peripheral curled rim 10*e*, which extends continuously along the free edges of the front wall 10*a*, the rear wall 10*b* and the opposed side walls 10*c* and 10*d* thereof and the base 11 similarly has a curled rim 11*e* extending continuously along the free edges of the front wall 11*a* the rear wall 11*b* and the opposed side walls 11*c* and 11*d* thereof. The uninterrupted curled rims 10*e* and 11*e*, which are of circularly curved cross section, serve to reinforce the walls of the lid 10 and the base 11 by very substantially increasing the rigidity and strength of these walls, which is of importance in camping stoves since such stoves are subjected to rough usage. These curled rims also provide rounded edges in order to prevent a risk of the user of the stove being cut by the edges of the lid 10 and the base 11.

Figure 3:
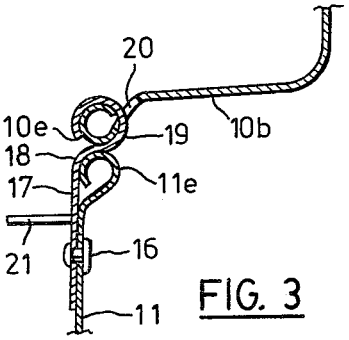

The lid 10 is pivotally secured to the base 11 by a sheet metal insert, indicated generally by reference numeral 15, which is secured by rivets 16 to the rear wall 11*b* of the base 11. The insert 15 comprises four integral projections in the form of tabs 17 which, as can be seen from FIGS. 1 and 3, extend upwardly along the inner surface of the base rear wall 11*b*. Adjacent the rim 11*e* of the base 11, each tab 17 has a rearwardly bent portion 18 extending in surface-to-surface contact with the rim 11*e* around part of the periphery of the rim 11*e* and merging with a forwardly and circularly bent portion 19, which extends partially around the lid rim 10*e* in wrapping relation therewith, the lid rim 10*e* being slidably pivotable within the forwardly bent portion 19 of each tab 17. The lid rear wall 10*b* is formed with four rectangular openings 20 adjacent the rim 10*e* to accommodate the forwardly bent portions 19 of the tabs 17 therethrough.

The insert 17 is also formed with three tabs or flanges 21, which are bent inwardly of the stove base 11 to form support brackets, the purpose of which is explained hereinafter.

The windshields 12 and 13 are pivotally secured to the opposed side walls 10*c* and 10*d* of the base 11 by projections in the form of tabs 24, which are integral with the shields 12 and 13. The tabs 24 project inwardly from the windshields 12 and 13 through openings 25 in the opposed side walls 11*c* and 11*d*, and thus beneath the base rim 11*e*, and are bent upwardly to curl in slidable wrapping relation and surface-to-surface contact with the base rim 11*e*.

As shown in FIG. 1, the lid 10 is releasably retained in its open position, and the windshields 12 and 13 are likewise releasably retained in their erected positions, by means of spring clips, indicated generally by reference numerals 27, connecting the windshields 12 and 13 to the lid 10.

Figure 2:
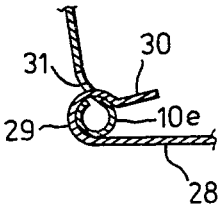

Each of the spring clips 27 is formed integral with the respective one of the windshields 12 and 13 by a projection in the form of a tab extending from the latter, the tab comprising a first, straight portion 28, a second, circularly curved portion 29 and a third, straight portion 30, as viewed in cross section in FIG. 2, the straight portion 30 extending from the curved portion 29 in a direction which is inclined away from the straight portion 28. The tabs forming the spring clips 27, being formed of the same sheet metal as the windshields 12 and 13, are resiliently deformable to enable the lid rim 10*e* to be received past the straight portions 30 into nested or wrapped relation in the curved portions 29 for engaging the clips 27 with the lid 10, the lid side walls 10*c* and 10*d* being formed with rectangular openings, one of which is indicated by reference numeral 31, for receiving the clips 27.

A pipe 33 is provided upon the exterior of the base side wall 11*d* for connection to a gas cannister (not shown), the pipe 33 being connected by pipes 34 and 35 to gas control valves 36, which in turn are connected by pipes 37 to burner rings 38, brackets 39 being secured to the bottom 11*f* of the base for supporting the burner rings 38. Control knobs 40 are connected to the gas control valves 36 and rotatably adjustable for controlling the flow of gas to the burner rings 38.

A pair of catches, indicated generally by reference numerals 42, are provided for securing the lid 10 to the base 11 when the lid 10 is in its closed position. One of the catches 42 is illustrated in FIG. 5 and it will be understood that the other catch 42 is identical.

Figure 5:
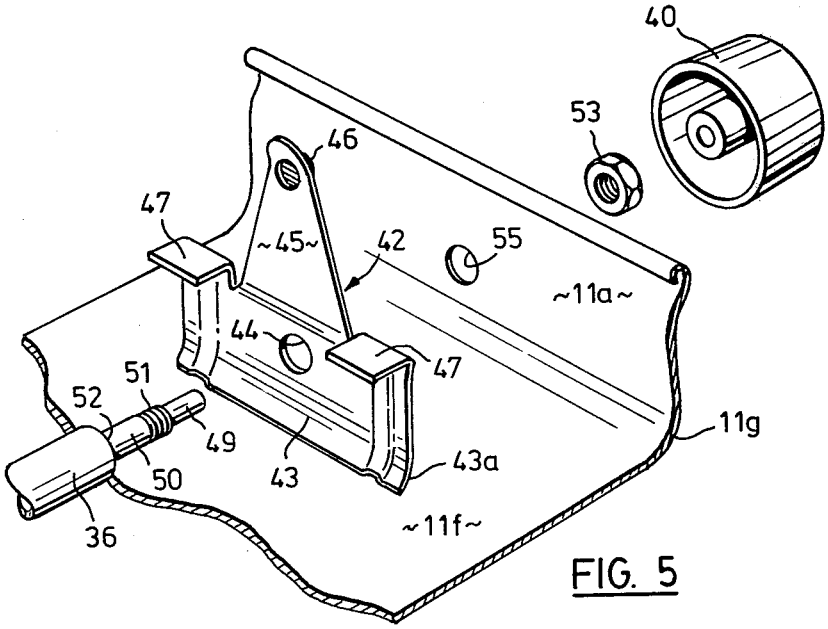
FIG. 5 shows a broken-away exploded view, in perspective, of parts of the stove of FIG. 1.
Figure 6:
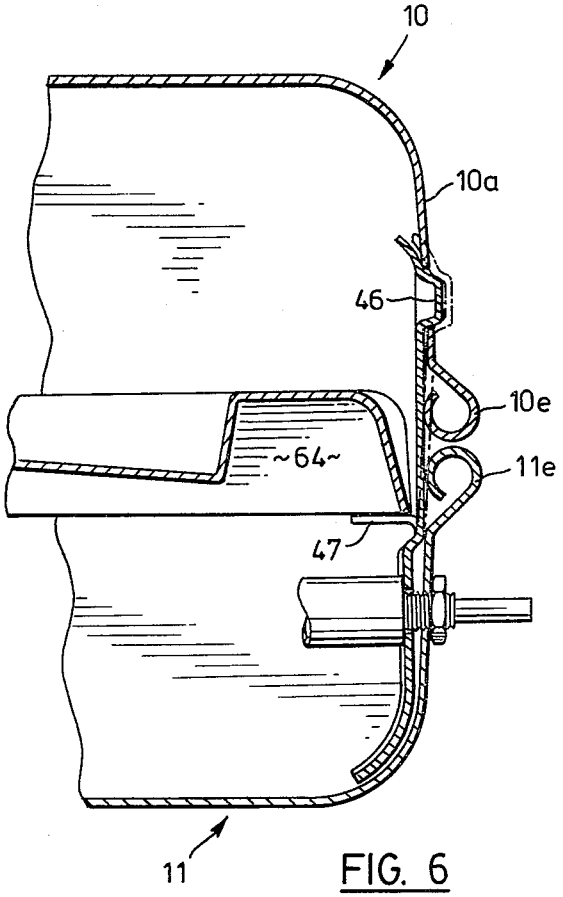
FIG. 6 shows a broken-away view in cross section of parts of the stove within the circle 6 of FIG. 4.

As shown in FIG. 5, the catch 42 is in the form of a sheet metal catch member having a lower portion 43, in which is provided a circular hole 44, an upstanding tongue 45, which is provided with a forwardly extending projection or detent 46, and a pair of flanges or tabs 47, which are bent so as to extend horizontally and rearwardly from the base front wall 11*a*.

The control knob 40 is shaped to fit onto the end of a shaft 49, which extends through a tube 50 formed with a screw thread 51 and an abutment shoulder 52. A nut 53 is provided at the exterior of the base 11 for threaded engagement with the screw thread 51. In the assembled condition of the stove, the shaft 49 and the tube 50 extend through the hole 44 in the catch member and through a corresponding hole 55 formed in the front wall 11*a* of the base 11, the nut 53 being tightened on the screw thread 51 to cause the abutment shoulder 52 to clamp the catch member against the base front wall 11*a*.

The base front wall 11*a* merges smoothly with the base bottom 11*f* through a curved portion 11*g*, and the lower portion 43 of the catch member is formed with a correspondingly curved lower edge portion 43*a*, which is held in surface-to-surface contact with the base curved portion 11*g* and thus prevents rotation of the catch member about the axis of the shaft 49.

The projection 46 is engagable in the corresponding one of a pair of circular openings 57 formed in the lid front wall 10*a*, the tongue 45 being resiliently deflectable to allow engagement and disengagement of the projection 46 and the hole 57.

To facilitate carrying of the stove when the stove is in its closed condition, the base bottom 11*f* is formed with a rectangular manually engagable opening 60, the forward edge of which is defined by a flange 61 projecting inwardly of the stove and bent to form a hand grip.

The base bottom 11*f* is also formed with depressions 62 and 63, serving as support feet. The stove is also provided with a deck or cover 64, and the purpose of the support brackets formed by the flanges 21 and 47 is to support the lower edge of the cover 64, as shown in FIG. 4.

As indicated hereinbefore, the lid 10 and the base 11 are made from identical workpieces, which considerably rationalizes the manufacture of these two components of the stove, and thus the front and rear walls 10*a* and 10*b* of the lid 10 have the same length and height dimensions as the front and rear walls 11*a* and 11*b* of the base 11, and likewise the opposed side walls 10*c* and 10*d* of the lid 10 have the same length and height dimensions as the base side walls 11*c* and 11*d*. During manufacture, identical dish-shaped workpieces are, therefore, manufactured, and some of these workpieces are then formed with openings 20, 31 and 57 to serve as stove lids and others are formed with openings 25, 55 and 60 and depressions 62 and 63, and provided with brackets 39 and inserts 17, to serve as stove bases.

It is, however, alternatively possible to provide two slightly different workpieces, using the same draw dies, to serve as the lid and the bottom, respectively, these two workpieces having corresponding walls of the same lengths but of heights which differ slightly, e.g. by $\frac{1}{4}$ inch.

The inserts 17 are inexpensive to manufacture and serve the dual functions of pivotally connecting the lids to the bases and supporting the cover 64 and the catches 42 are likewise inexpensive to manufacture and fulfill the dual function of catches and supporting the cover 64.

The curled rims 10*e* and 11*e* fulfill the dual functions of substantially reinforcing the lid 10 and the base 11 and also form rigid pivot bars for the pivotal interconnection of the pivotal connection of the lid 10 to the base 11 and the pivotal connection of the windshields 12 and 13 to the base 11 and for engagement with the catches 42, thus avoiding the use of additional components for these purposes.

I claim:

1. A portable stove, comprising:

a housing made of sheet metal;

said housing comprising a first housing portion forming a lid and a second housing portion forming a base; and burner means in said base for heating food;

said lid and said base each being dish-shaped and having a front wall, a rear wall and opposed side walls depending from a generally planar panel, said lid and said base being formed from similar workpieces with said front, rear and side walls of said lid having the same length and dimensions and at least substantially the same height dimensions as the corresponding walls of said base said lid having portions each being formed with a peripheral curled rim extending along said front, rear and side walls thereof and a pivotal connection between said rear walls of said portions allowing pivotation of said lid relative to said base between a closed position in which said rim of said lid is adjacent said rim of said base and an open position in which said lid is upstanding from said rear wall of said base, said pivotal connection being formed by sheet metal projections extending from the interior of one of said housing portions between said rim portions to the exterior of said other portion and curling around said rim of the other of said housing portions in pivotally slidable surface-to-surface relationship, said other housing being formed with openings in said rear wall thereof for receiving said projections.

2. A portable stove as claimed in claim 1 wherein said pivotal connection comprises a sheet metal member secured to said rear wall of said base and having flanges bent to form support brackets, said projections forming parts of said sheet metal member.

3. A portable stove as claimed in claim 1, further comprising catch means for releasably securing said lid and said base together with said lid in its closed psotion, said catch means comprising a catch member projecting from said front wall of one of said housing portions, means defining a hole in said front wall of the other of said housing positions and a protrusion on said catch member, said catch member being resiliently deflectable to permit engagement and disengagement of said protrusion and said hole.

4. A portable stove as claimed in claim 3, wherein said catch member is made of sheet metal and wherein means are provided for retaining said catch member in surface-to-surface contact with said front wall of said base, said stove further including gas duct means for supplying gas to said burner means, and means for adjusting the flow of gas through said gas duct means, said adjustment means comprising a control knob and a shaft extending through said catch member and said base front wall and said retaining means comprising a shoulder on said shaft within said base and in clamping engagement within said catch member.

5. A portable stove as claimed in claim 3, further comprising a shaft extending through said catch member and said base front wall and abutment means on said shaft for clamping said catch member against said base front wall, said base front wall and said catch member having adjacent rearwardly curving bottom portions in surface-to-surface contact which prevents rotation of said catch member about said shaft.

* * * * *